US011430602B2

(12) United States Patent
Igarashi et al.

(10) Patent No.: US 11,430,602 B2
(45) Date of Patent: Aug. 30, 2022

(54) COIL COMPONENT

(71) Applicant: Murata Manufacturing Co., Ltd., Kyoto-fu (JP)

(72) Inventors: Akio Igarashi, Nagaokakyo (JP); Yuuji Igarashi, Nagaokakyo (JP); Takao Miyamoto, Nagaokakyo (JP); Takuya Ishida, Nagaokakyo (JP); Koji Onishi, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 449 days.

(21) Appl. No.: 16/783,299

(22) Filed: Feb. 6, 2020

(65) Prior Publication Data

US 2020/0258678 A1 Aug. 13, 2020

(30) Foreign Application Priority Data

Feb. 7, 2019 (JP) ..... JP2019-020882

(51) Int. Cl.
*H01F 27/29* (2006.01)
*H01F 27/28* (2006.01)
*H01F 27/24* (2006.01)

(52) U.S. Cl.
CPC ..... *H01F 27/292* (2013.01); *H01F 27/24* (2013.01); *H01F 27/2823* (2013.01)

(58) Field of Classification Search
CPC ..... H01F 27/24; H01F 2017/0093; H01F 17/045; H01F 27/29
See application file for complete search history.

(56) References Cited

U.S. PATENT DOCUMENTS 10,600,559 B2 3/2020 Igarashi et al.
2004/0183147 A1* 9/2004 Togashi ..... H05K 3/3426 257/414
2013/0027161 A1* 1/2013 Urano ..... H01F 17/04 336/83
2016/0086730 A1* 3/2016 Park ..... H05K 3/3426 361/306.3

(Continued)

FOREIGN PATENT DOCUMENTS

DE 10 2017 207 019 A1 11/2017
DE 10 2019 212 672 A1 2/2020

(Continued)

OTHER PUBLICATIONS

Office Action issued by the German Patent Office dated Dec. 22, 2020, which corresponds to German Patent Application No. 10 2020 201 542.2 and is related to U.S. Appl. No. 16/783,299 with English language translation.

(Continued)

*Primary Examiner* — Sherman Ng
(74) *Attorney, Agent, or Firm* — Studebaker & Brackett PC

(57) ABSTRACT

An adhesive layer is in contact with a rising portion of a metal terminal and an outer end surface of a flange portion of a drum-shaped core. A surface of the rising portion that faces the outer end surface is an inclined surface that inclines with respect to the outer end surface. The thickest portion of the adhesive layer is located near a position at which a distance between the inclined surface and the outer end surface is largest. The thickness of the thickest portion of the adhesive layer is 13 μm or more.

17 Claims, 6 Drawing Sheets

(56) References Cited

U.S. PATENT DOCUMENTS

| | | | | |
|---|---|---|---|---|
| 2017/0194085 | A1 | 7/2017 | Takagi et al. | |
| 2017/0316874 | A1* | 11/2017 | Igarashi | H01F 27/292 |
| 2018/0130597 | A1* | 5/2018 | Komaya | H01F 17/045 |
| 2018/0286554 | A1* | 10/2018 | Kojima | H01F 27/29 |
| 2020/0066435 | A1 | 2/2020 | Igarashi et al. | |

FOREIGN PATENT DOCUMENTS

| | | | |
|---|---|---|---|
| JP | 2005-072038 | A | 3/2005 |
| JP | 2005-228827 | A | 8/2005 |
| JP | 2013-191694 | A | 9/2013 |
| JP | 2015-035473 | A | 2/2015 |

OTHER PUBLICATIONS

Office Action; "Notice of Reasons for Refusal," mailed by the Japanese Patent Office dated Oct. 5, 2021, which corresponds to Japanese Patent Application No. 2019-020882 and is related to U.S. Appl. No. 16/783,299 with English translation.

* cited by examiner

COIL COMPONENT

CROSS-REFERENCE TO RELATED APPLICATION

This application claims benefit of priority to Japanese Patent Application No. 2019-020882, filed Feb. 7, 2019, the entire content of which is incorporated herein by reference.

BACKGROUND

Technical Field

The present disclosure relates to a coil component, and more particularly, to a coil component in which a metal terminal that includes a metal plate is mounted on a drum-shaped core.

Background Art

An interesting technique for the present disclosure is disclosed in, for example, Japanese Unexamined Patent Application Publication No. 2015-35473. Japanese Unexamined Patent Application Publication No. 2015-35473 discloses a coil component in which metal terminals each of which includes a metal plate are mounted on a drum-shaped core. FIG. 10 is quoted from Japanese Unexamined Patent Application Publication No. 2015-35473 and corresponds to FIG. 1 in Japanese Unexamined Patent Application Publication No. 2015-35473.

A coil component 61 illustrated in FIG. 10 forms a common-mode choke coil and includes a drum-shaped core 62 that is composed of, for example, ferrite, a first wire 63, and a second wire 64. The drum-shaped core 62 includes a winding core portion (that is concealed under the wires 63 and 64 and is not illustrated) that has a circumferential surface on which the first and second wires 63 and 64 are wound and includes a first flange portion 65 and a second flange portion 66 that are disposed on end portions of the winding core portion that are opposite each other in the axial direction.

Two metal terminals 67 and 69 each of which includes a metal plate are mounted on the first flange portion 65. Two metal terminals 68 and 70 each of which includes a metal plate are mounted on the second flange portion 66. The metal terminal 70 is concealed under the second flange portion 66 and is not illustrated.

A first end of the first wire 63 is connected to the first metal terminal 67 that is disposed on the first flange portion 65. A second end of the first wire 63 opposite the first end is connected to the second metal terminal 68 that is disposed on the second flange portion 66. A first end of the second wire 64 is connected to the third metal terminal 69 that is disposed on the first flange portion 65. A second end of the second wire 64 opposite the first end is connected to the fourth metal terminal 70, not illustrated, that is disposed on the second flange portion 66.

The following description includes how the metal terminals 67 to 70 are mounted on the flange portions 65 and 66.

Each of the flange portions 65 and 66 has a bottom surface 71 that is to face a mounting substrate during mounting, an inner end surface 72 that faces the winding core portion, and an outer end surface 73 that is opposite the inner end surface 72 and that faces outward, and the end portions of the winding core portion are disposed on the inner end surfaces 72.

Each of the metal terminals 67 to 70 includes a basal portion 74 that is disposed near the bottom surface 71 of the flange portion 65 or 66, and a rising portion 76 that extends from the basal portion 74 across a bent portion 75 covering a ridge line portion along which the bottom surface 71 and the outer end surface 73 intersect each other and that is disposed near the outer end surface 73 of the flange portion 65 or 66.

The metal terminals 67 to 70 are secured to the flange portion 65 or 66 with an adhesive. The adhesive is applied between the rising portion 76 of each of the metal terminals 67 to 70 and the outer end surface 73 of the flange portion 65 or 66.

SUMMARY

With the structure disclosed in Japanese Unexamined Patent Application Publication No. 2015-35473, the adhesive is typically solidified with the rising portion 76 pressed against the outer end surface 73, and the adhesive forms a thin adhesive layer that has a uniform thickness. This achieves firm adhesion.

In some cases where the coil component 61, in which the first to fourth metal terminals 67 to 70 each of which includes the metal plate are thus mounted on the drum-shaped core 62 with the adhesive, is subjected to a heat cycle with the coil component 61 mounted on a mounting substrate such as a printed circuit board by soldering, adhesion between at least one of the first to fourth metal terminals 67 to 70 and the drum-shaped core 62 is lost.

The reason is that expansion and contraction during the heat cycle relatively greatly differ between the mounting substrate and the drum-shaped core 62 that is composed of ferrite. That is, the drum-shaped core 62 that is composed of ferrite less expands and contracts when subjected to the heat cycle, but the mounting substrate greatly expands and contracts. The first to fourth metal terminals 67 to 70 follow the behavior of the mounting substrate, and this relatively greatly changes distances from the first metal terminal 67 and the third metal terminal 69 that are mounted on the first flange portion 65 to the second metal terminal 68 and the fourth metal terminal 70 that are mounted on the second flange portion 66. Consequently, there is a problem in that adhesive layers in which the metal terminals 67 to 70 adhere to the drum-shaped core 62 crack, and that the adhesion is lost due to the crack in some cases.

In view of this, the present disclosure provides a coil component that inhibits adhesion between the metal terminals and the drum-shaped core from being lost even when the coil component is subjected to the heat cycle with the coil component mounted on the mounting substrate.

According to preferred embodiments of the present disclosure, a coil component includes a drum-shaped core that includes a winding core portion that extends in an axial direction, and a first flange portion and a second flange portion that are disposed on end portions of the winding core portion that are opposite each other in the axial direction, a wire that is wound around the winding core portion, and metal terminals that are electrically connected to end portions of the wire, that are mounted on the first flange portion and the second flange portion, and that include respective metal plates.

Each of the first flange portion and the second flange portion has a bottom surface that extends in the axial direction and that is to face a mounting substrate during mounting, and an outer end surface that faces in a direction opposite a direction toward the winding core portion and that extends in a direction that intersects the axial direction. Each of the metal terminals includes a basal portion that extends along the bottom surface of the first flange portion or the second flange portion, and a rising portion that extends along the outer end surface of the first flange portion or the second flange portion, wherein the metal terminals include a first metal terminal and a second metal terminal.

According to preferred embodiments of the present disclosure, in the coil component, a first adhesive layer is in contact with at least a part of the rising portion of the first metal terminal and at least a part of the outer end surface of the first flange portion. A second adhesive layer is in contact with at least a part of the rising portion of the second metal terminal and at least a part of the outer end surface of the second flange portion. A thickness of a thickest portion of the first adhesive layer that is measured in the axial direction is 13 μm or more.

A stress acts in each adhesive layer due to a difference between the situation of variation in dimensions of the drum-shaped core and the situation of variation in a distance between the metal terminal that is mounted on the first flange portion and the metal terminal that is mounted on the second flange portion, which is caused by a heat cycle with the coil component mounted on the mounting substrate. According to preferred embodiments of the present disclosure, however, at least a relatively thick portion of the first adhesive layer that has a thickness of 13 μm or more is subjected to the stress, and the stress in the adhesive layer is advantageously dispersed in the thickness direction. Accordingly, the stress in the adhesive layer can be reduced. Consequently, according to preferred embodiments of the present disclosure, the coil component enables adhesion between the metal terminals and the drum-shaped core to be unlikely to be lost.

The lower limit of the thickness of the thickest portion of the adhesive layer that is 13 μm is obtained by an experiment described later.

Other features, elements, characteristics and advantages of the present disclosure will become more apparent from the following detailed description of preferred embodiments of the present disclosure with reference to the attached drawings.

DETAILED DESCRIPTION

Figure 1A:
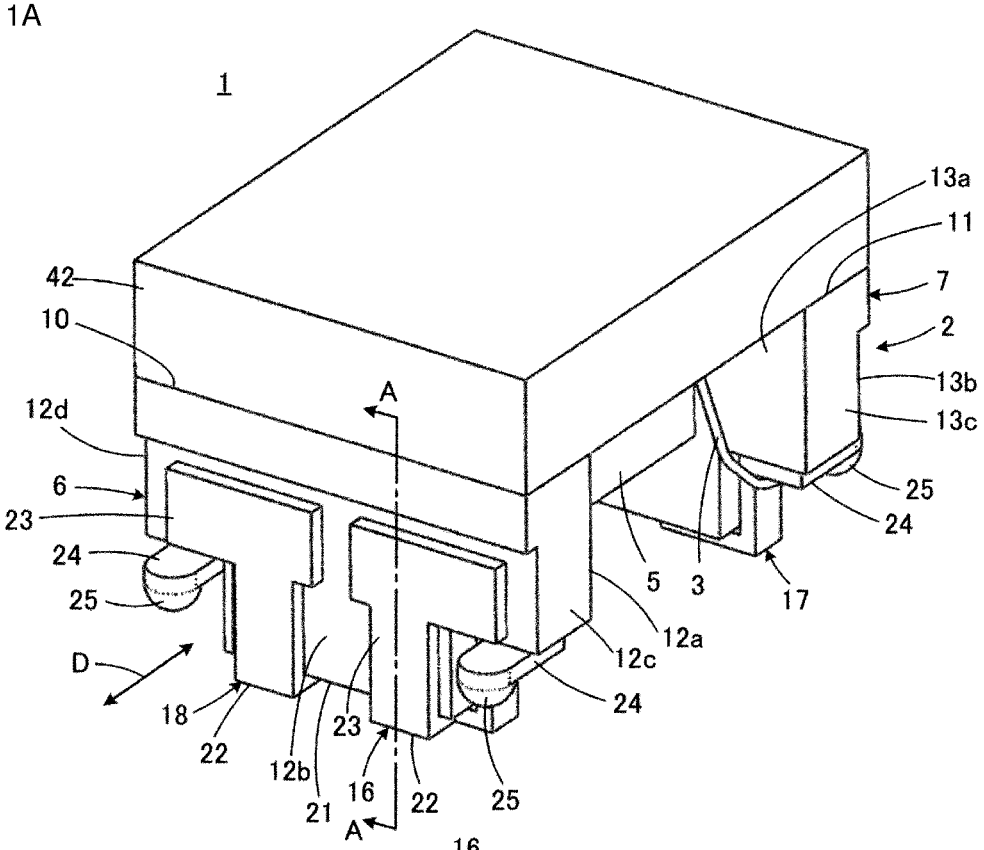
FIG. 1A is a perspective view of a coil component according to a first embodiment of the present disclosure when viewed from a relatively upper position.
Figure 1B:
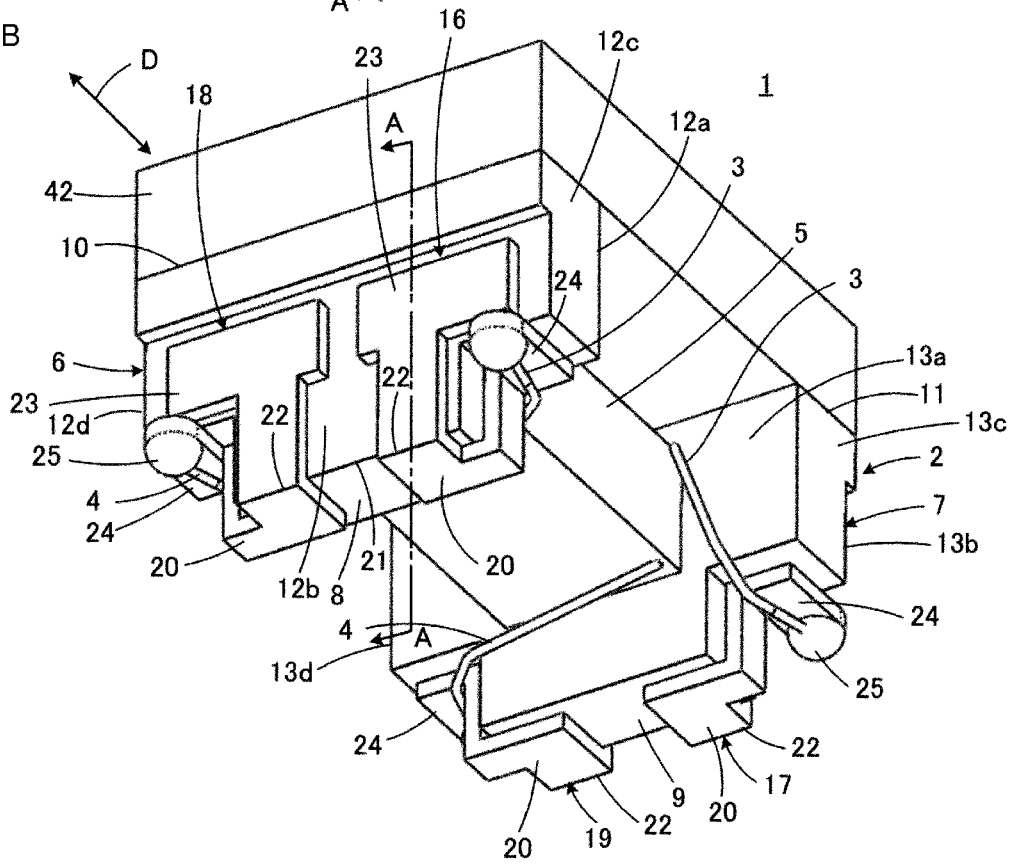
FIG. 1B is a perspective view of the coil component when viewed from a relatively lower position.

A coil component 1 according to a first embodiment of the present disclosure will be described with reference to FIG. 1A, FIG. 1B, and FIG. 2. The coil component 1 illustrated in FIG. 1A and FIG. 1B forms, for example, a common-mode choke coil. In FIG. 1A and FIG. 1B, an illustration of principal parts of two wires is omitted.

The coil component 1 includes a drum-shaped core 2. A first wire 3 and a second wire 4 are wound around the drum-shaped core 2. The drum-shaped core 2 includes a winding core portion 5 that extends in an axial direction D, and a first flange portion 6 and a second flange portion 7 that are disposed on end portions of the winding core portion 5 that opposite each other in the axial direction D. The drum-shaped core 2 is preferably composed of ferrite. The drum-shaped core 2 may be composed of a nonconductive material other than ferrite, for example, a non-magnetic material such as alumina, or a resin that contains ferrite powder or magnetic metal powder.

The winding core portion 5, the first flange portion 6, and the second flange portion 7 that are included in the drum-shaped core 2 have, for example, a substantially quadrangular prism shape having a substantially square sectional shape. Ridge line portions of the winding core portion 5, the first flange portion 6, and the second flange portion 7 having a substantially quadrangular prism shape are preferably round-chamfered although this is not illustrated. The sectional shape of the winding core portion 5, the first flange portion 6, and the second flange portion 7 may be a substantially polygonal shape such as a hexagon, a substantially circular shape, or a substantially ellipse shape, or a combination thereof, instead of a square.

The first flange portion 6 has a bottom surface 8 that extends in the axial direction D and that is to face a mounting substrate during mounting, and an upper surface 10 opposite the bottom surface 8. The first flange portion 6 also has an inner end surface 12*a* that extends upward from the bottom surface 8, that extends in the direction perpendicular to the mounting substrate, and that faces the winding core portion 5, an outer end surface 12*b* that extends upward from the bottom surface 8, that extends in the direction perpendicular to the mounting substrate, and that faces in the direction opposite the direction toward the winding core portion 5, and a first side surface 12*c* and a second side surface 12*d* that connect the inner end surface 12*a* and the outer end surface 12*b* to each other. The perpendicular direction includes a direction that is angled to a certain extent with respect to the perpendicular direction in addition to the direction precisely perpendicular to the mounting substrate.

Similarly to the first flange portion 6, the second flange portion 7 has a bottom surface 9 that extends in the axial direction D and that is to face the mounting substrate during mounting, and an upper surface 11 opposite the bottom surface 9. The second flange portion 7 also has an inner end surface 13*a* that extends upward from the bottom surface 9, that extends in the direction perpendicular to the mounting substrate, and that faces the winding core portion 5, an outer end surface 13*b* that extends upward from the bottom surface 9, that extends in the direction perpendicular to the mounting substrate, and that faces in the direction opposite the direction toward the winding core portion 5, and a first side surface 13*c* and a second side surface 13*d* that connect the inner end surface 13*a* and the outer end surface 13*b* to each other.

Steps that are formed so as to protrude along upper sides of the outer end surfaces 12*b* and 13*b* of the flange portions 6 and 7 are not essential and may not be formed.

A first metal terminal 16 and a third metal terminal 18 are spaced from each other and mounted on the first flange portion 6. A second metal terminal 17 and a fourth metal terminal 19 are spaced from each other and mounted on the second flange portion 7. Each of the first to fourth metal terminals 16 to 19 is typically manufactured by processing a metal plate that is composed of a copper alloy such as phosphor bronze or tough pitch copper. Tin plating is preferably performed on the metal plate that corresponds to the material of each of the first to fourth metal terminals 16 to 19. The metal plate has a thickness of, for example, no less than 0.10 mm and no more than 0.15 mm (i.e., from 0.10 mm to 0.15 mm).

As illustrated in FIG. 1A and FIG. 1B, each of the first metal terminal 16 and the third metal terminal 18 includes a basal portion 20 that extends along the bottom surface 8 of the first flange portion 6, and a rising portion 23 that is connected to the basal portion 20 across a bent portion 22 covering a ridge line portion 21 along which the bottom surface 8 and the outer end surface 12*b* of the first flange portion 6 intersect each other, and that extends along the outer end surface 12*b* of the first flange portion 6. Each of the first metal terminal 16 and the third metal terminal 18 also includes a connection piece 24 that extends from the basal portion 20.

In FIG. 1A and FIG. 1B, the second metal terminal 17 and the fourth metal terminal 19 are partly illustrated. The above first metal terminal 16 and the fourth metal terminal 19 have the same shape. The second metal terminal 17 and the above third metal terminal 18 have the same shape. Accordingly, reference characters 20, 22, 23, and 24 that designate the basal portion, the bent portion, the rising portion, and the connection piece of each of the above first metal terminal 16 and the above third metal terminal 18 are also used to designate those of the second metal terminal 17 and the fourth metal terminal 19 as needed.

A first end of the first wire 3 is electrically connected to the connection piece 24 of the first metal terminal 16. A second end of the first wire 3 opposite the first end is electrically connected to the connection piece 24 of the second metal terminal 17. A first end of the second wire 4 is electrically connected to the connection piece 24 of the third metal terminal 18. A second end of the second wire 4 opposite the first end is electrically connected to the connection piece 24 of the fourth metal terminal 19. These are electrically connected by, for example, laser welding. FIG. 1A and FIG. 1B illustrate weld nugget portions 25 each of which is formed by laser welding and bulges into a hemispherical shape.

The first wire 3 and the second wire 4 typically have a substantially circular sectional shape and each include a linear, central conductor and an insulating coating that covers the circumferential surface of the central conductor and that is composed of an electrically insulating resin. The diameter of the central conductor is, for example, no less than 28 μm and no more than 50 μm (i.e., from 28 μm to 50 μm). The thickness of the insulating coating is, for example, no less than 3 μm and no more than 6 μm (i.e., from 3 μm to 6 μm). The central conductor is composed of good conductive metal such as copper, silver, or gold. The insulating coating is composed of a resin that contains at least an imide linkage such as polyamide imide or imide-modified polyurethane.

The first wire 3 and the second wire 4 are spirally wound around the winding core portion 5 in the same direction although an illustration thereof is omitted in FIG. 1A and FIG. 1B. More specifically, the first wire 3 and the second wire 4 may be wound so as to form two layers such that the first wire 3 or the second wire 4 is wound inside, and the other is wound outside, or may be wound such that the turns of each wire are alternately arranged in the axial direction of the winding core portion 5 and are parallel with each other in a bifilar winding manner.

The first and third metal terminals 16 and 18 are mounted on the first flange portion 6 with an adhesive. The second and fourth metal terminals 17 and 19 are mounted on the second flange portion 7 with an adhesive. Mounted portions thereof will now be described in detail with reference to FIG. 2 in which a section along line A-A in FIG. 1A and FIG. 1B is illustrated. FIG. 2 illustrates a portion at which the first metal terminal 16 is mounted on the first flange portion 6. The mounted portions of the second to fourth metal terminals 17 to 19 are substantially the same as the mounted portion of the first metal terminal 16, and a detailed description thereof is omitted.

Figure 2:
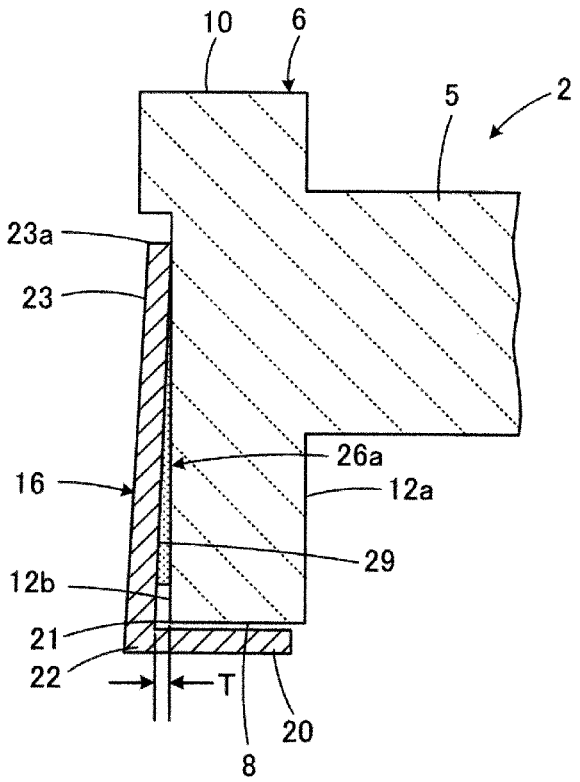
FIG. 2 is an enlarged sectional view taken along line A-A in FIG. 1A and FIG. 1B and illustrates a portion at which a first metal terminal is mounted on a first flange portion of the coil component illustrated in FIG. 1A and FIG. 1B.
Figure 4:
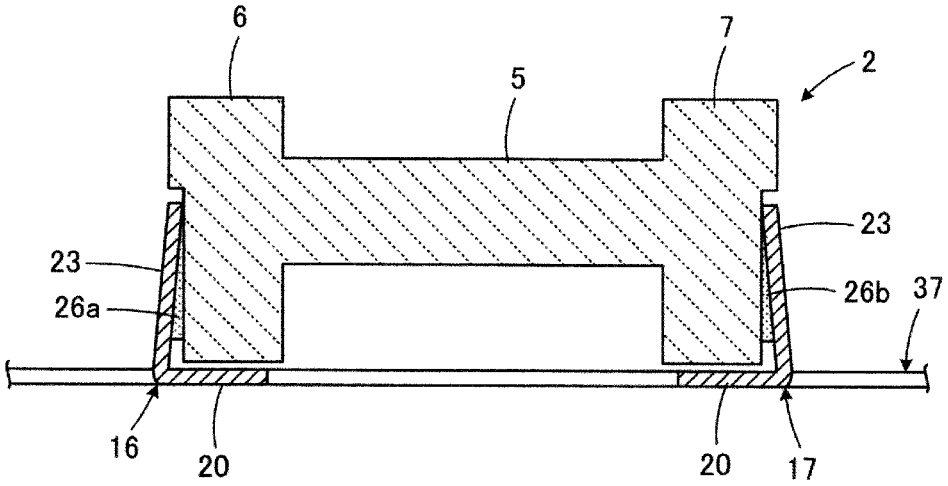
FIG. 4 illustrates an example of a method of mounting the first metal terminal and a second metal terminal to the first flange portion illustrated in FIG. 2 with a sectional view.

As illustrated in FIG. 2, a first adhesive layer 26*a* that is formed by the above adhesive is in contact with the rising portion 23 of the first metal terminal 16 and the outer end surface 12*b* of the first flange portion 6. A second adhesive layer 26*b*, a third adhesive layer 26*c*, and a fourth adhesive layer 26*d* that are disposed correlatively on the second metal terminal 17, the third metal terminal 18, and the fourth metal terminal 19 have the same form as that of the first adhesive layer 26*a*. FIG. 4, which will be described later, illustrates only the second adhesive layer 26*b* among the adhesive layers 26*b* to 26*d* for convenience. The third adhesive layer 26*c* and the fourth adhesive layer 26*d* are not illustrated in the figures but are designated by reference characters 26*c* and 26*d*. An example of the adhesive that forms the first to fourth adhesive layers 26*a* to 26*d* is an epoxy based adhesive agent. The epoxy based adhesive agent may contain a filler such as silica particles. The adhesive that contains hard particles having a large particle diameter such as silica particles ensures the thickness of each adhesive layer.

According to the embodiment, the bottom surface 8 and the outer end surface 12*b* of the first flange portion 6 are perpendicular to each other, and the rising portion 23 of the first metal terminal 16 has a plate shape. A surface of the rising portion 23 that faces the outer end surface 12*b* is an inclined surface 29 that inclines with respect to the outer end surface 12*b*. More specifically, the basal portion 20 and the rising portion 23 of the first metal terminal 16 are connected to each other and interpose the bent portion 22 that covers the ridge line portion 21 along which the bottom surface 8 and the outer end surface 12*b* of the first flange portion 6 intersect each other. The entire surface of the rising portion 23 that faces the outer end surface 12*b* corresponds to the inclined surface 29.

An interior angle that is formed between the basal portion 20 and the rising portion 23 at the bent portion 22 is an acute angle and is, more specifically, no less than 70 degrees and less than 90 degrees (i.e., from 70 degrees to 90 degrees). Accordingly, the thickest portion of the first adhesive layer 26*a* is located near a portion of the rising portion 23 nearest to the bent portion 22 at a position at which the distance between the inclined surface 29 and the outer end surface 12*b* is largest. The thickness T of the thickest portion of the first adhesive layer 26*a* that is measured in the axial direction D is 13 μm or more, preferably 19 μm or more. The lower limit of the thickness T is calculated from data illustrated in FIG. 3 described later. In some cases, the bent portion 22 is actually not bent at a predetermined angle because of variations in manufacture or differences in quality and has, for example, a curved portion or a portion having a different angle.

It is revealed that, in an existing coil component, a crack due to a heat cycle with the existing coil component mounted on a mounting substrate causes adhesion to be lost, and the crack is grown as the number of heat cycles increases and developed in the direction from an end of a rising portion to a basal portion.

Regarding the latter phenomenon, according to the embodiment, the thickest portion of the first adhesive layer 26*a* is located nearest to the basal portion 20. This advantageously disperses a stress that acts on the first adhesive layer 26*a* in the final step at which the develop of the crack is finished. Accordingly, the crack of the first adhesive layer 26*a* can be prevented from being completely developed, and the adhesion can be prevented from being zero.

According to the embodiment, the first to fourth adhesive layers 26*a* to 26*d* are in contact with at least parts of the rising portions 23 of the first to fourth metal terminals 16 to 19 and at least parts of the outer end surfaces 12*b* and 13*b* of the first flange portion 6 and the second flange portion 7. In this case, a force in a separation direction acts on the first to fourth adhesive layers 26*a* to 26*d* due to the heat cycle. The force in the separation direction acts in the thickness direction of the first to fourth adhesive layers 26*a* to 26*d*. Accordingly, resistance against the force in the separation direction increases as the thicknesses of the first to fourth adhesive layers 26*a* to 26*d* increase.

It is assumed that the first to fourth adhesive layers 26*a* to 26*d* are conducive to improvement in adhesive strength near the ends 23*a* of the rising portions 23 at which the dimension thereof in the thickness direction is relatively small.

Figure 3:
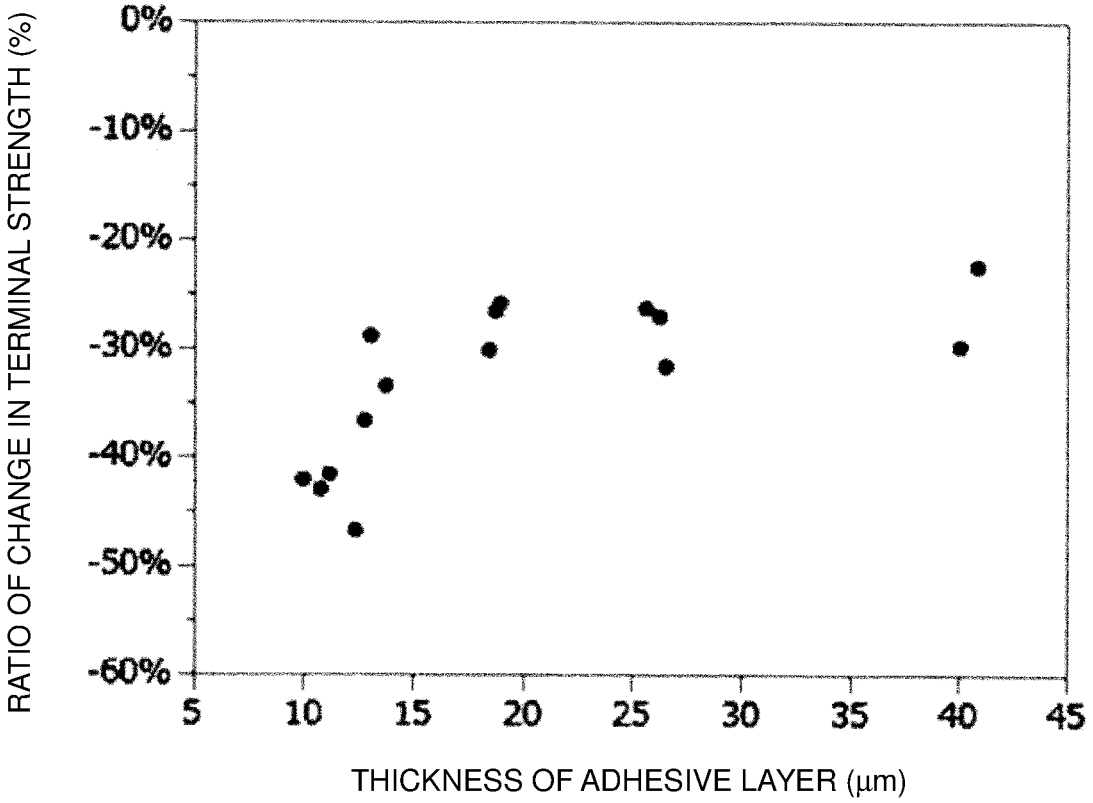
FIG. 3 illustrates a relationship between the thickness of an adhesive layer and a ratio of change in a terminal strength before and after a heat cycle test, which is a ground for determination that the lower limit of the thickness of the thickest portion of the adhesive layer is 13 μm.

FIG. 3 and Table 1 illustrate a relationship between the thicknesses of the first to fourth adhesive layers 26*a* to 26*d* and a ratio of change in terminal strength of the coil component 1 to that of the mounting substrate after a heat cycle test. The "terminal strength" is a strength that is measured when the component is pressed in the direction parallel to the substrate with the component soldered to the mounting substrate. The adhesive that forms the first to fourth adhesive layers 26*a* to 26*d* is the epoxy based adhesive agent. Environment conditions of the heat cycle test include 1000 repetitive cycles of a temperature variation ranging from −55° C. to 150° C. The ratio of change in the terminal strength is based on the terminal strength before the heat cycle test and is calculated as a ratio of reduction in the terminal strength after the heat cycle test. The reduction in the terminal strength against the mounting substrate corresponds to a phenomenon of separation of portions of the first to fourth adhesive layers 26*a* to 26*d*.

TABLE 1

| Thickness of Adhesive Layer (μm) | Ratio of Change in Terminal Strength (%) | Evaluation |
|---|---|---|
| 10.0 | −42 | x |
| 10.8 | −43 | x |
| 11.2 | −42 | x |
| 12.4 | −47 | x |
| 12.8 | −37 | ○ |
| 13.1 | −29 | ○ |
| 13.8 | −33 | ○ |
| 18.5 | −30 | ○ |
| 18.8 | −27 | ○ |
| 19.0 | −26 | ○ |
| 25.7 | −26 | ○ |
| 26.3 | −27 | ○ |
| 26.6 | −32 | ○ |
| 40.1 | −30 | ○ |
| 40.9 | −23 | ○ |

Referring to FIG. 3 and Table 1, there is a tendency that the absolute value of the ratio of change in the terminal strength decreases as the thicknesses of the first to fourth adhesive layers 26*a* to 26*d* increase. As marks "○" are entered in a column of "Evaluation" in Table 1, when the thicknesses of the first to fourth adhesive layers 26*a* to 26*d* are 13 μm or more, the absolute value of the ratio of change in the terminal strength is 40% or less in an increased number of samples, and an effect of inhibiting the terminal strength from decreasing starts working. When the thicknesses of the first to fourth adhesive layers 26*a* to 26*d* are 19 μm or more, there are no samples in which the absolute value of the ratio of change in the terminal strength greatly exceeds 30%, and the terminal strength are inhibited from decreasing with certainty.

From the above results, the thickness T of the thickest portion of each of the first to fourth adhesive layers 26*a* to 26*d* is 13 μm or more, preferably 19 μm or more, as described above.

The upper limit of the thickness T of the thickest portion of each of the first to fourth adhesive layers 26*a* to 26*d* is 100 μm preferably 70 μm, with which a normal adhesion process can be performed without hindrance.

As illustrated in FIG. 2, no adhesive is applied between the bottom surface 8 of the first flange portion 6 and the basal portion 20 of the first metal terminal 16. However, an adhesive may be applied therebetween. The same is true for the other embodiments described later. During the heat cycle, a force in a shear direction acts on an adhesive layer that is formed by the adhesive that is applied between the bottom surface 8 of the first flange portion 6 and the basal portion 20 of the first metal terminal 16. The thickness of the adhesive layer on which the force in the shear direction acts may be less than 13 μm.

To obtain the structure illustrated in FIG. 2, in the first to fourth metal terminals 16 to 19 that are prepared before an adhesion process is performed, the interior angle that is formed between the basal portion 20 and the rising portion 23 is preferably an acute angle and is, more specifically, no less than 70 degrees and less than 90 degrees (i.e., from 70 degrees to 90 degrees). In a sectional view in FIG. 4, a part of a hoop-like member 37 that includes a metal plate and that forms parts that become the first metal terminal 16 and the second metal terminal 17 is illustrated. In FIG. 4, the parts that become the third metal terminal 18 and the fourth metal terminal 19 are concealed under the first metal terminal 16 and the second metal terminal 17 and are not illustrated. The longitudinal direction of the hoop-like member 37 coincides with the direction perpendicular to the paper surface of FIG. 4.

For example, the epoxy based adhesive agent is applied to a predetermined region of each of the rising portions 23 that are held by the hoop-like member 37 in the portions that become the first to fourth metal terminals 16 to 19. Subsequently, the drum-shaped core 2 is disposed between the first metal terminal 16 and the second metal terminal 17 and between the third metal terminal 18 and the fourth metal terminal 19. The above epoxy based adhesive agent becomes the adhesive layers 26*a* to 26*d* that are disposed between the first to fourth metal terminals 16 to 19 and the drum-shaped core 2. The drum-shaped core 2 is held by an elastic force acting from the first and third metal terminals 16 and 18 and the second and fourth metal terminals 17 and 19 that interpose the drum-shaped core 2. In this state, the interior angle that is formed between the basal portion 20 and the rising portion 23 of each of the portions that become the first to fourth metal terminals 16 to 19 is maintained to be no less than 70 degrees and less than 90 degrees (i.e., from 70 degrees to 90 degrees).

The above hoop-like member 37 holds a number of the drum-shaped cores 2 that are arranged at regular intervals in the longitudinal direction, although this is not illustrated. A length of the hoop-like member 37 is cut with about 20 drum-shaped cores 2 being held.

Subsequently, the cut hoop-like member 37 is put into an oven and heated, for example, at a temperature of no less than 130° C. and no more than 170° C. (i.e., from 130° C. to 170° C.) for a time of no less than 30 minutes and no more than 60 minutes (i.e., from 30 minutes to 60 minutes), and the adhesive is solidified. Consequently, the first to fourth adhesive layers 26*a* to 26*d* are formed.

Subsequently, the portions that become the first to fourth metal terminals 16 to 19 are cut from the hoop-like member 37 and taken out together with the drum-shaped core 2. The first and second wires 3 and 4 are wound around the winding core portion 5. The first and second wires 3 and 4 are connected to the connection pieces 24 (see FIG. 1) of the first to fourth metal terminals 16 to 19.

The coil component 1 that has the structure illustrated in FIG. 1A and FIG. 1B is thus obtained.

In an existing method, a thin adhesive layer that has a uniform thickness is formed, a rising portion of a metal terminal is relatively strongly pressed against the outer end surface of a flange portion in an adhesion process to achieve firm adhesion, and an adhesive is solidified with this state maintained. According to the embodiment, however, when the rising portions 23 of the first to fourth metal terminals 16 to 19 are brought into contact with the outer end surface 12*b* of the first flange portion 6 and the outer end surface 13*b* of the second flange portion 7, the interior angle that is formed between the basal portion 20 and the rising portion 23 is maintained to be no less than 70 degrees and no more than 110 degrees (i.e., from 70 degrees to 110 degrees). Accordingly, provided that this state is maintained, the rising portions 23 of the first to fourth metal terminals 16 to 19 may be pressed against the outer end surface 12*b* of the first flange portion 6 and the outer end surface 13*b* of the second flange portion 7, or only the ends 23*a* of the rising portions 23 may be pressed.

As illustrated in FIG. 1A and FIG. 1B, the coil component 1 may include a plate core 42 that extends across the upper surface 10 of the first flange portion 6 and the upper surface 11 of the second flange portion 7. The plate core 42 is preferably composed of ferrite as with the drum-shaped core 2. The plate core 42 may be composed of a nonconductive material other than ferrite, for example, a non-magnetic material such as alumina, or a resin that contains ferrite powder or magnetic metal powder.

The plate core 42 adheres to the upper surface 10 of the first flange portion 6 and the upper surface 11 of the second flange portion 7 with an adhesive not illustrated. Consequently, the plate core 42 can form a closed magnetic circuit in corporation with the drum-shaped core 2. Examples of the adhesive include an epoxy resin adhesive and an epoxy resin adhesive that contains a silica filler. An adhesive that contains no filler is preferably used to narrow gaps between the plate core 42 and the first and second flange portions 6 and 7 as much as possible.

Referring to FIG. 5 to FIG. 8, the other embodiments of the present disclosure will be described. FIG. 5 to FIG. 8 correspond to FIG. 2 and illustrate the first metal terminal 16 that is mounted on the first flange portion 6. The mounted portions of the second to fourth metal terminals 17 to 19 are substantially the same as the mounted portion of the first metal terminal 16, and a description thereof is omitted. In FIG. 5 to FIG. 8, components corresponding to the components illustrated in FIG. 2 are designated by like reference characters, and a duplicated description is omitted.

Figure 5:
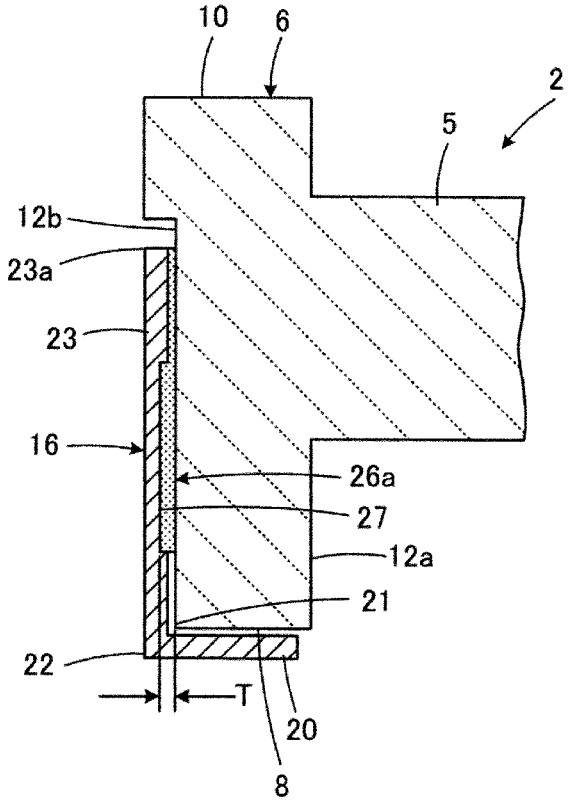
FIG. 5 is an enlarged sectional view for description of a second embodiment of the present disclosure and corresponds to FIG. 2.

According to a second embodiment illustrated in FIG. 5, a recessed portion 27 is formed in a part of a surface of the rising portion 23 of the first metal terminal 16 in contact with the first adhesive layer 26*a*, more specifically, a part of a surface in contact with the first adhesive layer 26*a* near the basal portion 20. Accordingly, the portion of the first adhesive layer 26*a* that has the maximum thickness T is located within the recessed portion 27. The recessed portion 27 enables the portion of the first adhesive layer 26*a* that has the maximum thickness T to be readily formed.

The thickness T of the thickest portion of the first adhesive layer 26*a* is 13 μm or more, preferably 19 μm or more, as described above. The upper limit of the thickness T of the thickest portion of the first adhesive layer 26*a* is 100 μm, preferably 70 μm, with which a normal adhesion process can be performed without hindrance.

In the above description, the thickness T means the thickness that satisfies the above conditions.

The recessed portion 27 of the rising portion 23 described above can be formed by thinning a part of the rising portion 23, for example, by a coining process. The recessed portion 27 may be formed by pushing a part of the rising portion 23, for example, by an embossing process.

Figure 6:
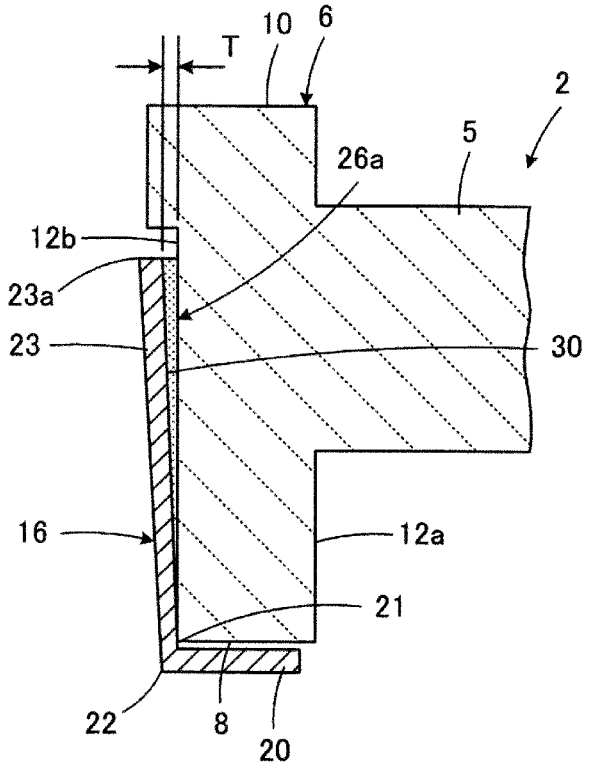
FIG. 6 is an enlarged sectional view for description of a third embodiment of the present disclosure and corresponds to FIG. 2.

According to a third embodiment illustrated in FIG. 6, a positional relationship between a thick portion and a thin portion of the first adhesive layer 26*a* is reverse to that according to the first embodiment. The portion of the first adhesive layer 26*a* that has the maximum thickness T is located farthest from the basal portion 20, that is, near the end 23*a* of the rising portion 23.

More specifically, the bottom surface 8 and the outer end surface 12*b* of the first flange portion 6 are perpendicular to each other, and the rising portion 23 of first metal terminal 16 has a plate shape. The entire surface of the rising portion 23 that faces the outer end surface 12*b* is an inclined surface 30 that inclines with respect to the outer end surface 12*b*. The interior angle that is formed between the basal portion 20 and the rising portion 23 at the bent portion 22 is an obtuse angle and is, more specifically, more than 90 degrees and no more than 110 degrees. Accordingly, the thickest portion of the first adhesive layer 26*a* that has the thickness T is located nearest to the end 23*a* of the rising portion 23. In some cases, the bent portion 22 is actually not bent at a predetermined angle because of variations in manufacture or differences in quality and has, for example, a curved portion or a portion having a different angle as in the above description.

In the above phenomenon, the crack due to the heat cycle with the existing coil component mounted on the mounting substrate causes the adhesion to be lost, and the crack is developed in the direction from the end 23*a* of the rising portion 23 to the basal portion 20. According to the embodiment, however, the portion that has the maximum thickness T is located farthest from the basal portion 20, that is, near the end 23*a* of the rising portion 23. This advantageously disperses a stress that acts on the first adhesive layer 26*a* in the final step at which the crack starts developing. Accordingly, the first adhesive layer 26*a* is unlikely to crack, and the crack is unlikely to be developed.

The dimension in the thickness direction of the portion of the first adhesive layer 26*a* nearest to the basal portion 20 is relatively small, and it is assumed that the portion is conducive to improvement in the adhesive strength.

Figure 7:
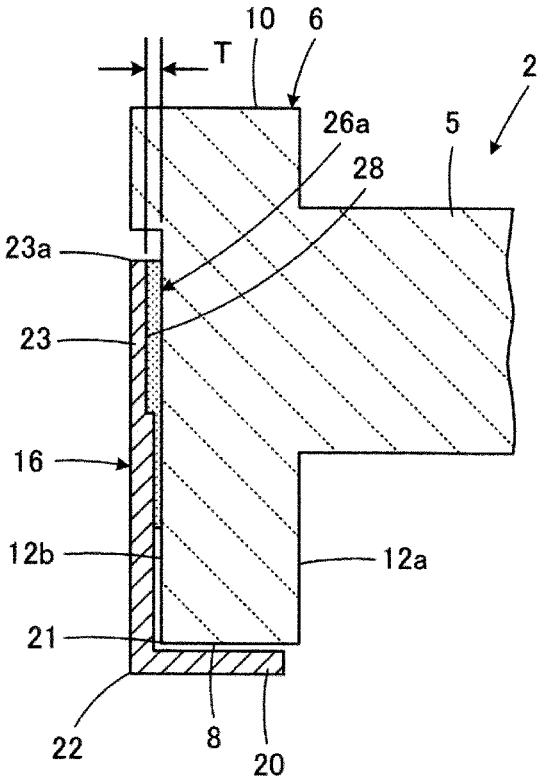
FIG. 7 is an enlarged sectional view for description of a fourth embodiment of the present disclosure and corresponds to FIG. 2.

According to a fourth embodiment illustrated in FIG. 7, a recessed portion 28 is formed in a part of a surface of the rising portion 23 of the first metal terminal 16 in contact with the first adhesive layer 26*a*, more specifically, a surface in contact with the first adhesive layer 26*a* near the end 23*a* of the rising portion 23. Accordingly, the portion of the first adhesive layer 26*a* that has the maximum thickness T is located within the recessed portion 28. The recessed portion 28 enables the portion of the first adhesive layer 26*a* that has the maximum thickness T to be readily formed.

The recessed portion 28 of the rising portion 23 described above can be formed by thinning a part of the rising portion 23, for example, by the coining process as with the second embodiment illustrated in FIG. 5. The recessed portion 28 may be formed by pushing a part of the rising portion 23, for example, by the embossing process.

Figure 8:
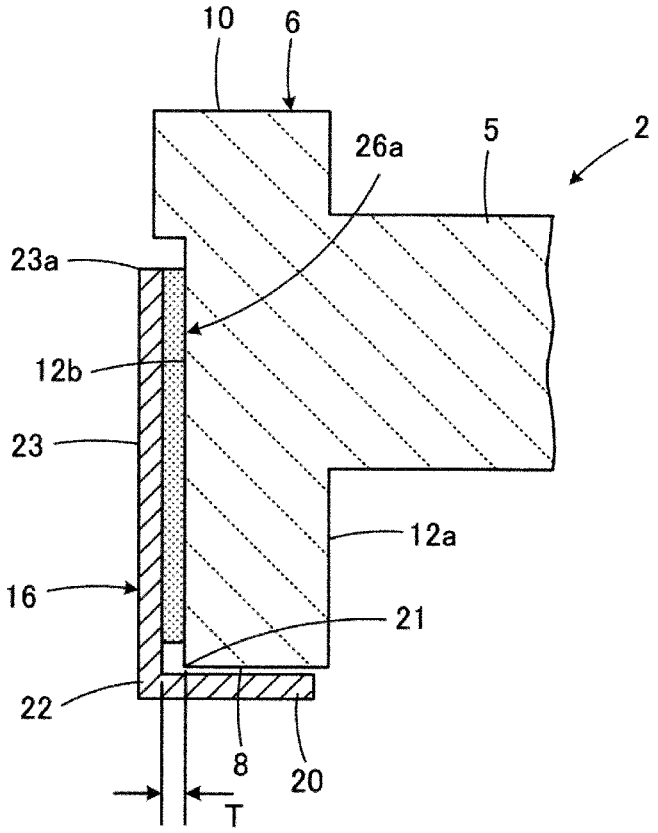
FIG. 8 is an enlarged sectional view for description of a fifth embodiment of the present disclosure and corresponds to FIG. 2.

According to a fifth embodiment illustrated in FIG. 8, a surface of the rising portion 23 of the first metal terminal 16 that faces the outer end surface 12*b* of the first flange portion 6 extends parallel to the outer end surface 12*b*, and the first adhesive layer 26*a* has a uniform thickness. In this case, the substantially entire first adhesive layer 26*a* has the maximum thickness T.

Figure 9:
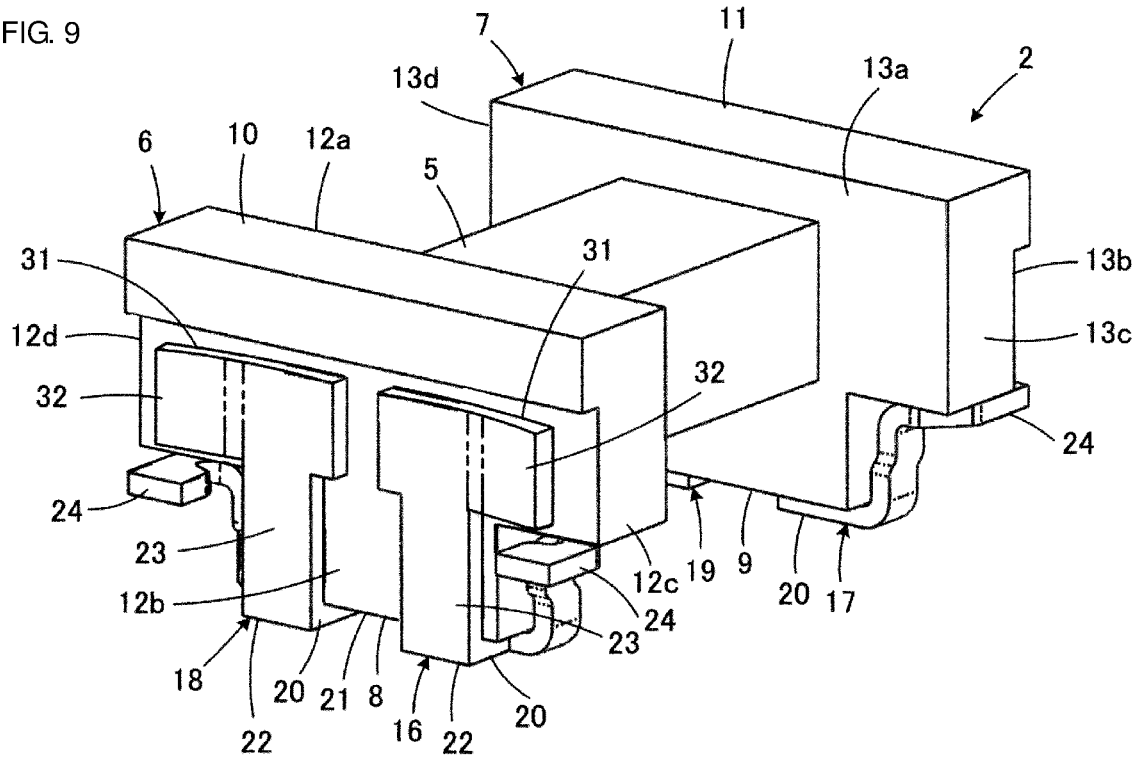
FIG. 9 is a perspective view of a coil component according to a sixth embodiment of the present disclosure.
Figure 10:
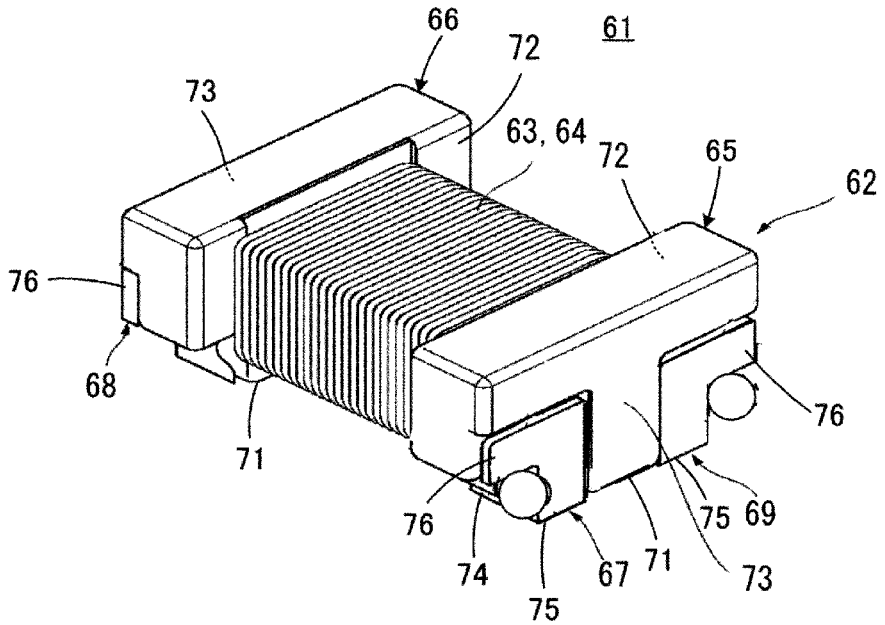
FIG. 10 is a perspective view of a coil component disclosed in Japanese Unexamined Patent Application Publication No. 2015-35473.

A coil component 1*a* according to a sixth embodiment of the present disclosure will now be described with reference to FIG. 9. The coil component 1*a* forms, for example, a common-mode choke coil. However, an illustration of two wires and the end portions of each wire after welding is omitted. In FIG. 9, components corresponding to the components illustrated in FIG. 1A and FIG. 1B are designated by like reference characters, and a duplicated description is omitted.

According to the sixth embodiment, each of the first metal terminal 16 and the third metal terminal 18 includes the basal portion 20 that extends along the bottom surface 8 of the first flange portion 6, and the rising portion 23 that is connected to the basal portion 20 across the bent portion 22 covering the ridge line portion 21 along which the bottom surface 8 and the outer end surface 12*b* of the first flange portion 6 intersect each other, and that extends along the outer end surface 12*b* of the first flange portion 6. Each of the first metal terminal 16 and the third metal terminal 18 also includes the connection piece 24 that extends from the basal portion 20, as with the first embodiment.

A part of a surface of the rising portion 23 of each of the first and third metal terminals 16 and 18 that faces the outer end surface 12*b* of the first flange portion 6 corresponds to an inclined surface 31. More specifically, the rising portion 23 of each of the first and third metal terminals 16 and 18 includes a protruding portion 32 that protrudes in a direction that intersects the axial direction of the winding core portion 5 and that is parallel to the direction in which the basal portion 20 extends. The protruding portion 32 slightly curves with respect to the other portions of the rising portion 23. The inclined surface 31 corresponds to the surface of the protruding portion 32 that faces the outer end surface 12*b*.

The adhesive layer is in contact with the inclined surface 31 and the outer end surface 12*b* of the protruding portion 32, although this is not illustrated in FIG. 9. The thickest portion of the adhesive layer is located nearest to an end of the protruding portion 32, and the thickness thereof is 13 μm or more.

The second metal terminal 17 and the fourth metal terminal 19 that are mounted on the second flange portion 7 are partly illustrated in FIG. 9. The above first metal terminal 16 and the fourth metal terminal 19 have the same shape. The second metal terminal 17 and the above third metal terminal 18 have the same shape. Accordingly, for the second metal terminal 17 and the fourth metal terminal 19, the adhesive layer is formed as with the above first metal terminal 16 and the above third metal terminal 18.

Also, according to the sixth embodiment, the same effects as those according to the first embodiment described above can be achieved.

According to the first to sixth embodiments described above, in all of the first to fourth adhesive layers 26*a* to 26*d* relative to the first metal terminals 16 to 19, the thickness of the thickest portion of the adhesive layer is 13 μm or more, preferably 19 μm or more. However, all of the first to fourth adhesive layers 26*a* to 26*d* may not have this structure, and one or some of the first to fourth adhesive layers 26*a* to 26*d* may have this structure.

According to the embodiments illustrated in FIG. 2 and FIG. 6, the outer end surfaces 12*b* and 13*b* of the flange portions 6 and 7 are perpendicular to the bottom surfaces 8 and 9, the rising portion 23 of each of the metal terminals 16 to 19 intersects the basal portion 20 but is not perpendicular thereto, and consequently, the thickness of the thickest portion of each of the adhesive layers 26*a* to 26*d* is 13 μm or more. Alternatively, the outer end surfaces 12*b* and 13*b* of the flange portions 6 and 7 may intersect the bottom surfaces 8 and 9 but not be perpendicular thereto, the rising portion 23 of each of the metal terminals 16 to 19 may be perpendicular to the basal portion 20, and consequently, the thickness of the thickest portion of each of the adhesive layers 26*a* to 26*d* is 13 μm or more. Alternatively, the outer end surfaces 12*b* and 13*b* of the flange portions 6 and 7 may intersect the bottom surfaces 8 and 9 but are not perpendicular thereto, the rising portion 23 of each of the metal terminals 16 to 19 may intersect the basal portion 20 but is not perpendicular thereto, and consequently, the thickness of the thickest portion of each of the adhesive layers 26*a* to 26*d* is 13 μm or more. In any case, the same effects as those according to the embodiments illustrated in FIG. 2 and FIG. 6 can be achieved.

A coil component according to the present disclosure is described above on the basis of the more specific embodiments of the common-mode choke coil. The embodiments are described by way of example, and other various modifications can be made. Accordingly, the number of the wires included in the coil component, the winding direction of the wires, and the number of the metal terminals, for example, can be changed in accordance with the function of the coil component.

The embodiments are described in the specification by way of example, and features can be partially replaced or combined between the embodiments.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

a drum-shaped core that includes a winding core portion that extends in an axial direction, and a first flange portion and a second flange portion that are disposed on end portions of the winding core portion that are opposite each other in the axial direction;

a wire that is wound around the winding core portion; and metal terminals that are electrically connected to end portions of the wire, that are mounted on the first flange portion and the second flange portion, and that include respective metal plates, wherein each of the first flange portion and the second flange portion has a bottom surface that extends in the axial direction and that is to face a mounting substrate during mounting, and an outer end surface that faces in a direction opposite a direction toward the winding core portion and that extends in a direction that intersects the axial direction, each of the metal terminals includes a basal portion that extends along the bottom surface of the first flange portion or the second flange portion, and a rising portion that extends along the outer end surface of the first flange portion or the second flange portion, the metal terminals include a first metal terminal and a second metal terminal, a first adhesive layer is in contact with at least a part of the rising portion of the first metal terminal and at least a part of the outer end surface of the first flange portion, a second adhesive layer is in contact with at least a part of the rising portion of the second metal terminal and at least a part of the outer end surface of the second flange portion, a thickness of a thickest portion of the first adhesive layer that is measured in the axial direction is 13 μm or more, at least a part of a surface of the rising portion of the first metal terminal that faces the outer end surface is an inclined surface that inclines with respect to the outer end surface, and the thickest portion of the first adhesive layer is located near a position at which a distance between the inclined surface and the outer end surface is largest.

2. The coil component according to claim 1, wherein a thickness of a thickest portion of the second adhesive layer that is measured in the axial direction is 13 μm or more.

3. The coil component according to claim 1, wherein the thickness of the thickest portion of the first adhesive layer that is measured in the axial direction is 19 μm or more.

4. The coil component according to claim 3, wherein a thickness of a thickest portion of the second adhesive layer that is measured in the axial direction is 19 μm or more.

5. The coil component according to claim 1, wherein the first adhesive layer and the second adhesive layer contain an epoxy based adhesive agent.

6. The coil component according to claim 1, wherein the basal portion and the rising portion of the first metal terminal are connected to each other and interpose a bent portion that covers a ridge line portion along which the bottom surface and the outer end surface intersect each other, and an entire surface of the rising portion that faces the outer end surface corresponds to the inclined surface.

7. The coil component according to claim 6, wherein an interior angle that is formed between the basal portion and the rising portion of the first metal terminal at the bent portion is from 70 degrees to 90 degrees, and the thickest portion of the first adhesive layer is located nearest to the bent portion of the rising portion.

8. The coil component according to claim 6, wherein the interior angle that is formed between the basal portion and the rising portion of the first metal terminal at the bent portion is from 90 degrees to 110 degrees, and the thickest portion of the first adhesive layer is located farthest from the bent portion of the rising portion.

9. The coil component according to claim 1, wherein a part of the surface of the rising portion of the first metal terminal that faces the outer end surface corresponds to the inclined surface.

10. The coil component according to claim 9, wherein a part of the rising portion of the first metal terminal that protrudes in a direction that intersects the axial direction and that is parallel to a direction in which the basal portion extends has the inclined surface.

11. The coil component according to claim 1, wherein a recessed portion is formed in a part of a surface of the rising portion of the first metal terminal that faces the outer end surface, and the thickest portion of the first adhesive layer is located within the recessed portion.

12. The coil component according to claim 2, wherein the thickness of the thickest portion of the first adhesive layer that is measured in the axial direction is 19 μm or more.

13. The coil component according to claim 2, wherein the first adhesive layer and the second adhesive layer contain an epoxy based adhesive agent.

14. The coil component according to claim 3, wherein the first adhesive layer and the second adhesive layer contain an epoxy based adhesive agent.

15. The coil component according to claim 4, wherein the first adhesive layer and the second adhesive layer contain an epoxy based adhesive agent.

16. The coil component according to claim 2, wherein a recessed portion is formed in a part of a surface of the rising portion of the first metal terminal that faces the outer end surface, and the thickest portion of the first adhesive layer is located within the recessed portion.

17. The coil component according to claim 3, wherein a recessed portion is formed in a part of a surface of the rising portion of the first metal terminal that faces the outer end surface, and the thickest portion of the first adhesive layer is located within the recessed portion.

* * * * *